United States Patent [19]

Wren et al.

[11] Patent Number: 4,696,133

[45] Date of Patent: Sep. 29, 1987

[54] BUILDING WITH COVERED INTERIOR OPEN SPACE

[75] Inventors: Michael Wren, Rushville; Paul W. Lantz, Columbus; George W. Acock, Jr., Columbus; James A. Rhodes, Columbus, all of Ohio

[73] Assignee: James A. Rhodes & Associates, Columbus, Ohio

[21] Appl. No.: 822,491

[22] Filed: Jan. 27, 1986

Related U.S. Application Data

[63] Continuation-in-part of Ser. No. 541,212, Oct. 12, 1983, abandoned.

[51] Int. Cl.[4] ..... F04B 1/342

[52] U.S. Cl. ..... 52/80; 52/6; 52/2; 52/236.3

[58] Field of Search ..... 52/2, 6, 80, 82, 86, 52/200, 234, 236.3, 169.6, 169.1

[56] References Cited

U.S. PATENT DOCUMENTS

| | | | |
|---|---|---|---|
| Re. 27,232 | 11/1971 | McLorg | 52/2 |
| 3,412,509 | 11/1968 | Popil | 52/2 |
| 3,579,932 | 5/1971 | Atkinson | 52/6 X |
| 3,619,958 | 11/1971 | Viesi | 52/6 |
| 3,815,299 | 6/1974 | Sörensen et al. | 52/2 X |
| 4,094,110 | 6/1978 | Dickens et al. | 52/86 X |
| 4,305,235 | 12/1981 | Roston | 52/2 |
| 4,452,017 | 6/1984 | Tang et al. | 52/80 |
| 4,608,785 | 9/1986 | Rhodes et al. | 52/236.3 X |

*Primary Examiner*—J. Karl Bell

*Attorney, Agent, or Firm*—Beveridge, DeGrandi & Weilacher

[57] ABSTRACT

A building includes an annular structure having inner and outer walls and a dome roof enclosing building units. An open space within inner wall is covered by air-supported fabric dome roof. Through selection of surface areas, thicknesses, and coefficients of heat transfer, for a given temperature difference the rate of heat flow through the inner wall is substantially equal to the rate of heat flow through the dome roof, providing optimum efficiency of climate control, including minimizing heat loss or gain, therefore minimizing power requirments for atmospheric control within the building and pen space. Preferably, the surface area of inner wall is substantially equal to the surface area of the dome roof.

12 Claims, 4 Drawing Figures

BUILDING WITH COVERED INTERIOR OPEN SPACE

CROSS-REFERENCE TO RELATED APPLICATION

This application is a continuation-in-part of U.S. patent application Ser. No. 541,212, filed Oct. 12, 1983 and now abandoned.

FIELD OF THE INVENTION

The present invention relates to building designs having covered interior courtyards, and more specifically to building designs particularly suited for office, residential apartment or condominium buildings in which an interior open space is covered with an air-supported dome roof.

BACKGROUND OF THE INVENTION

Buildings having interior courtyards are quite old. It was common in ancient Rome to have a central courtyard in the homes of wealthy families. These courtyards provided a gathering space open to the elements, which was quite pleasant during fair weather, but unusable during rain, sleet, snow or excessive cold, heat or humidity.

More recently, economics and personal preferences have led to the development of large scale apartment and business condominium projects in which each individual family or business has its own living or business space within a larger structural unit. Such construction, however, has not encouraged use of a Roman style courtyard, largely because the desired high density land use discourages provision of sufficient openings through the structure to permit adequate air flow, with the result that in unpleasant weather, for example on a humid summer day with the sun shining into such a courtyard, the courtyard cannot benefit from any breeze and becomes uncomfortably hot and sticky.

Having a roof over the courtyard makes it all-weather and allows it to be used in all climatic conditions. A heating and air conditioning system can then maintain the desired temperature and humidity within the covered courtyard, while keeping the level of pollutants to a minimum. The use of an air-supported, translucent roof to cover the courtyard and provide a controlled climate within the courtyard is advantageous not only because such a roof is economical but also because such a roof can be sufficiently opaque that it blocks direct heat-creating sunlight, yet sufficiently transparent to provide ample light during the day.

Air-supported roofs are known, such as the one installed on the Silverdome Stadium in Pontiac, Michigan. Such structures permit control of the climate within the building. However, the climate control within such a structure is highly inefficient and, therefore, is prohibitively expensive for use on building or office units. The present invention provides additional improvements over installations of this type in that the structure of the present invention permits efficient control of the climate within the structure.

SUMMARY OF THE INVENTION

The present invention is a building having rooms surrounding a dome-covered open space or courtyard. The building has an annular structure with inner and outer walls enclosing individual units such as apartments or office suites. The open space is located within the inner wall, and for a given temperature difference the rate of heat flow through the dome roof substantially equals the rate of heat flow through the interior wall. Preferably, the materials from which the dome roof and the interior wall are made have substantially equal rates of heat flow per unit area, and the surface area of the dome roof substantially equals the surface area of the inner wall. Preferably, also, the dome roof is an air-supported fabric and is secured to the annular structure along the top of the inner wall.

In a preferred arrangement, the inner wall is circular and the dome roof is a portion of a sphere. This arrangement permits optimum efficiency and control of heating, cooling, humidity and other environmental factors. In one preferred embodiment the diameter of the dome roof is eight times the vertical distance from the top of the inner wall to the top of the dome roof.

In another preferred arrangement, the inner wall is triangular, and the resulting interior open space is covered by a triangular dome roof.

BRIEF DESCRIPTION OF THE DRAWINGS

These and other aspects and advantages of the present invention will be better understood from the following detailed description and claims together with the accompanying drawings in which:

DETAILED DESCRIPTION OF PREFERRED EMBODIMENTS

Figure 1:
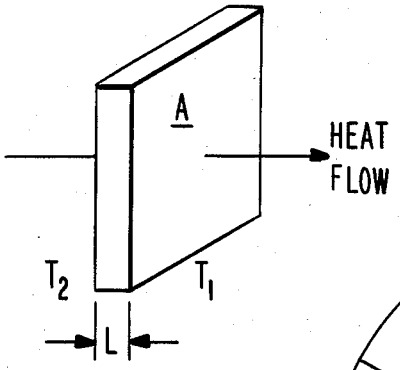
FIG. 1 is a schematic representation useful in explaining the invention.

As is well known, conduction of heat takes place in a body when different parts of the body are at different temperatures, and the direction of heat flow is from points of higher temperature to points of lower temperature. See, for example, chapter 17, "Transfer of Heat," from Sears and Zemansky, *University Physics,* Addison-Wesley Press, Inc., 1949, pages 275, et seq. FIG. 1 represents a slab of sheet material of cross sectional area A and thickness L. If the left face of the sheet material is at a temperature $T_2$ and the right face is at a lower temperature $T_1$, heat flows from left to right through the sheet material. The rate of heat flow, H, through the sheet material is given by $$H = \frac{KA\,(T_2 - T_1)}{L},$$

or $$H = -KA\frac{at}{ax},$$

where K is the coefficient of thermal conductivity of the sheet material.

For a given temperature difference $T_2 - T_1 = \Delta T$, the rate of heat flow, H, through the sheet can be varied by varying the material from which the sheet is formed so as to vary the coefficient of thermal conductivity K, by varying the area A of the sheet, or by varying the thickness L of the sheet. If more than one of these three factors is varied, and the variations are properly controlled, the same rate of heat flow can be achieved through different sheets. Thus, if a first sheet has an area $A_1$ and is formed of a material having a coefficient of thermal conductivity $K_1$, while a second sheet has an area $A_2$ and is formed of a material having a coefficient of thermal conductivity $K_2$, the thickness $L_1$ and $L_2$ of the two sheets can be controlled so that $$\frac{K_1A_1}{L_1} = \frac{K_2A_2}{L_2}$$

Then, for a given temperature difference $\Delta T$, $H_1=H_2$. This simply requires that $$\frac{L_1}{L_2} = \frac{K_1A_1}{K_2A_2}.$$

If $A_1=A_2$, then $$\frac{L_1}{L_2} = \frac{K_1}{K_2}.$$

Figure 2:
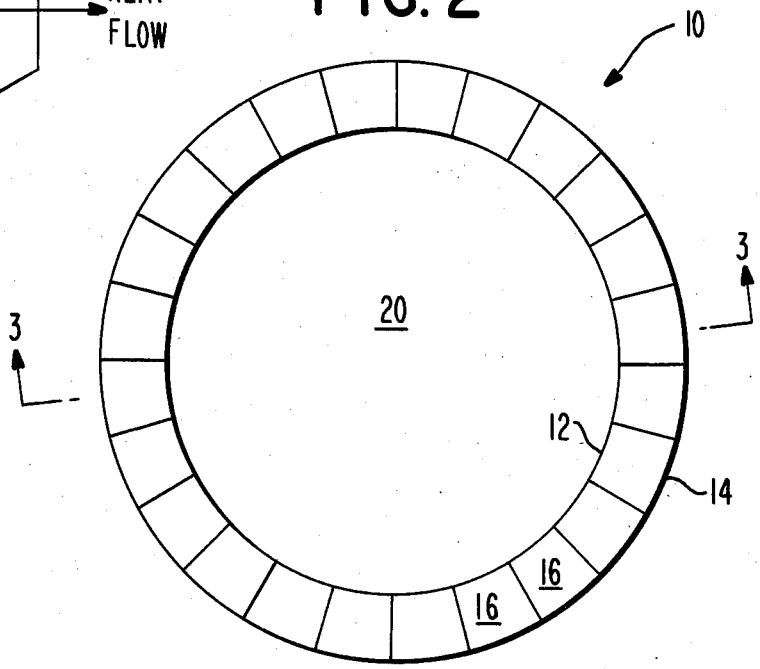
FIG. 2 is a diagrammatic view of one preferred embodiment of a structure in accordance with the present invention, taken generally along line 2—2 of FIG. 3.
Figure 3:
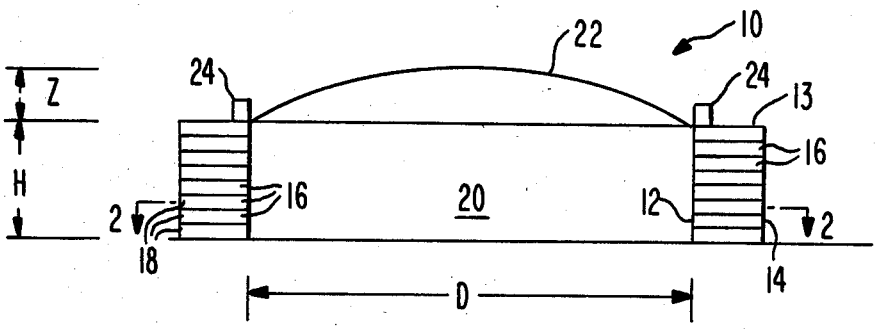
FIG. 3 is a diagrammatic sectional view taken along line 3—3 in FIG. 2.

Building structure 10, depicted in FIGS. 2 and 3, has a circular, annular cross-section, with an inner wall 12, an outer wall 14, and an annular roof 13. An interior courtyard 20 is provided within inner wall 12. The interior of annular building 10 includes several floors 18, each subdivided into a number of interior units 16 such as apartment units. The particular layout of interior units 16 can, of course, be varied to suit specific design requirements. Each unit 16 can extend to several rooms. As is conventional, different apartment units 16 are positioned one above another, but one or more apartments can extend vertically to more than one floor 18, if desired.

Courtyard 20 can be an empty space, but it is advantageously provided with facilities for one or more recreational pursuits. For instance, children's play equipment, one or more swimming pools, tennis courts, jogging tracks, exercise equipment, basketball courts, or the like may be installed in courtyard 20, as desired.

A dome roof 22 covers courtyard 20. Preferably the dome roof 22 is an air-supported architectural fiberglass fabric structure. One suitable fabric is Structo-Fab fabric formed from fiberglass yarn coated with Teflon fluorocarbon synthetic resin and available from the Fabric Structure Division of Owens-Corning Fiberglas Corp., Toledo, Ohio. This material is used, for example, for the roof of the Silverdome Stadium in Pontiac, Michigan, and has been found to be satisfactory. Although it is preferred for roof 22 to be affixed to structure 10 at the top of inner wall 12, the securement can be anywhere on the annular roof 13.

Fans 24 constantly supply air to the interior of courtyard 20 to assure sufficient air pressure beneath dome roof 22 to maintain the arch of the dome. Backup generators may be supplied to operate fans 24 and maintain inflation of dome roof 22 even during power failures. Further, if desired, roof 22 could be maintained in position by mechanical tension or by lightweight supports. Further detail about roofs made of such materials can be found in the publication "Architectural Fiberglas Fabric Structures," Owens-Corning Fiberglas Corp., Pub. No. 1-FS-8188E, Copyright 1982.

Preferably, dome roof 22 has a spherical curvature, although, of course, other shapes could be used. Moreover, if the structure 10 is noncircular, then a corresponding modification in the shape of roof 22 may be preferable. Atmospheric control for the space under dome roof 22 can be provided to maintain the desired conditions within the courtyard 20. This may be achieved by air conditioners, a furnace, heat pumps, dehumidifiers, air filters and the like and if desired can utilize fans 24 for air flow.

Figure 4:
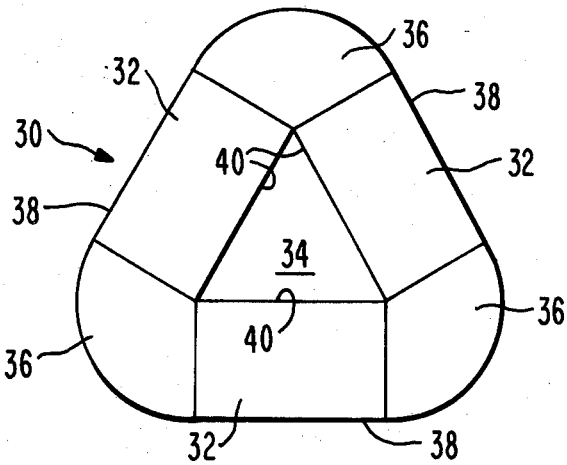
FIG. 4 is a diagrammatic plan view of another preferred embodiment of a structure in accordance with the present invention.

The present invention is not limited to circular buildings, so long as the building is annular; that is, so long as the building has a closed outer wall enclosing a closed inner wall and a courtyard therewithin. Regular geometric shapes are preferred, but non-geometric shapes can also be utilized. FIG. 4 shows a building 30 having an essentially triangular, annular cross-section including three rectangular building sections 32 positioned to provide a triangular inner courtyard 34. At the corners of triangular courtyard 34, the ends of the adjacent building sections 32 are joined by arcuate sections 36. Each rectangular section 32 of building 30 has an exterior building wall 38 and an interior building wall 40, with the interior walls 40 defining courtyard 34. Each section 32 includes several floors of interior units, similar to those of building 10. Arcuate sections 36 of building 30 can be either glass enclosed to contain indoor recreational and leisure areas for the occupants of building 30 or can be of brick, wood, or other conventional construction to contain recreational and leisure areas, commercial units or additional apartment units, or a mixture of various use facilities, as desired.

As seen in FIGS. 2–4, interior wall 12 or 40 separates the interior units 16 from courtyard 20 or 34. Considering building 10 of FIGS. 2 and 3, if the temperature within units 16 is different from the temperature within courtyard 20, heat flows through interior wall 12. Thus, for example, if units 16 are at a temperature Tu while courtyard 20 is at a temperature $T_c<T_u$, heat flow through wall 12 takes place at the rate $$Hw = \frac{KwAw\,(\mathrm{Tu} - \mathrm{Tc})}{Lw}$$

where Kw is the coefficient of thermal conductivity of the material from which wall 12 is made, Aw is the surface area of wall 12, and Lw is the thickness of the wall.

Likewise, if the temperature within courtyard 20 is different from the ambient temperature outside building 10, heat flows through dome roof 22. For example, if courtyard 20 is at a temperature Tc while the outside ambient temperature is Ta<Tc, heat flow takes place through dome roof 22 at the rate $$Hr = \frac{KrAr\,(Tc - Ta)}{Lr}$$

where Kr is the coefficient of thermal conductivity of the material from which dome roof 22 is made, Ar is the surface area of roof 22, and Lr is the thickness of the roof.

If there were no roof over courtyard 20, the interior of courtyard 20 would be substantially at the ambient exterior temperature Ta, while the interior units 16 would be at temperature Tu, and the heat flow between interior units 16 and the ambient temperature would take place through interior wall 12. With dome roof 22 in place, the temperature Tc of the courtyard interior approaches the temperature Tu of units 16 and a substantial part of the heat flow takes place through the roof. In the absence of heating and cooling of courtyard 20, in cold weather with units 16 being heated, Ta<Tc<Tu, while in hot weather with units 16 being cooled by air conditioning, Tu<Tc<Ta. Heating or cooling of courtyard 20 brings Tc≅Tu so that there is little or no heat flow through interior wall 12. Since courtyard 20 is enclosed on all sides by wall 12, the only significant heat flow to or from the courtyard is through dome roof 22, and thus optimum energy usage, occurs when $$\frac{Kw\,Aw}{Lw} = \frac{Kr\,Ar}{Lr}.$$

Since the total energy lost through roof 22 of dome covered courtyard 20 equals the energy lost through the interior walls 12 of an uncovered courtyard, the space within the covered courtyard is made more usable with no additional energy requirement.

It is preferred that Aw=Ar. Not only does this offer optimum architectual scale and proportion to courtyard 20, insofar as the scale of the interior wall 12 height in proportion to the skydome area of roof 22, but also the usable space within courtyard 20 is a maximum in relation to the roof area. Additionally, the building is less susceptible to damage from heavy winds. If Aw=Ar, then for optimum energy usage $$\frac{Kw}{Kr} = \frac{Lw}{Lr} \text{ or}$$

$$Lw = Lr\frac{Kw}{Kr}$$

Thus, for a given roof material having thickness Lr and coefficient of thermal conductivity Kr and a given wall material having coefficient of thermal conductivity Kw, the optimum relationship can be obtained by controlling the thickness of the wall Lw.

If wall 12 is circular with a height H and an inner diameter D and dome roof 22 is a section of a sphere with a height Z above the upper surface of inner wall 12, then to provide optimum efficiency with the surface area of the dome roof equal to the surface area of the inner wall, the following relationships must exist:

$$\text{Area of sidewall} = \pi DH$$

$$\text{Area of Dome roof} = \pi\left(\frac{D^2}{4} + Z^2\right)$$

$$\text{Therefore, } H = \frac{D}{4} + \frac{Z^2}{D}$$

In one particularly preferred embodiment $Z=D/8$, and so the surface area of the dome roof$=(17/64)\pi D^2$ and H=(17/64) D.

The area of the courtyard may be any desired size, however, it is preferably between about 4.5 and about 6.5 acres. In the just-described preferred embodiment, a courtyard size of 4.5 acres corresponds to a diameter of about 485 feet and a height H of about 130 feet or about thirteen floors 18. At 6.5 acres, the diameter is about 580 feet and the height is about 155 feet or about 15 floors.

Building 10 or 30 might be utilized for apartment or office rental or condominium units, medical facilities, hotels, rehabilitation centers, manufacturing buildings or other residential, commercial or industrial purposes as well as other possible uses. In each adaptation the units 16 can be arranged as desired for the use to which the space is to be put. Likewise, the courtyard 20 or 34 can be provided with any suitable facilities. The invention is particularly well suited for hospitals and other medical centers because the climate of the rooms and courtyard can be controlled and filtered of pollen, pollutants, dust, and the like, increasing the well-being of the occupants. The constant environment gives occupants a greater sense of security, health, and well-being, all of which contribute to improved health.

Although preferred embodiments of the invention have been described, modifications and rearrangements, including other sizes and proportions, may be employed in practicing the invention.

What is claimed is:

1. A building system having enclosed building units surrounding a dome-covered open space, said building system comprising an annular structure having an annular inner wall, an annular outer wall, and a plurality of interior walls, said walls defining said building units, with an open space located within said inner wall; a dome roof covering the open space; said inner wall having a surface area Aw and a thickness Lw and being formed of a material having a coefficient of thermal conductivity Kw and said roof having a surface area Ar and a thickness Lr and being formed of a material having a coefficient of thermal conductivity Kr such that KwAw/Lw=KrAr/Lr, thereby providing improved climate control, including minimizing heat loss or gain, and so minimizing power requirements for atmospheric control within the building and open space.

2. A building system as claimed in claim 1 in which the surface area Aw of said inner wall is substantially equal to the surface area Ar of said dome roof.

3. A building system as claimed in claim 1 wherein said inner wall is substantially circular.

4. A building system as claimed in claim 3 wherein said dome roof is a section of a sphere.

5. A building system as claimed in claim 4 wherein the diameter of said dome roof is about eight times the vertical distance from the top of said inner wall to the top of said dome roof.

6. A building system as claimed in claim 3 wherein said inner wall has a diameter between about 500 and 600 feet.

7. A building system as claimed in claim 1 wherein said inner wall is substantially triangular.

8. A building system as claimed in claim 1 wherein the open space has an area between about 4.5 acres and about 6.5 acres.

9. A building system as claimed in claim 1 wherein said dome roof is an air-supported fabric.

10. A building system as claimed in claim 9 wherein said fabric is secured to said annular structure along the top of said inner wall.

11. A building system as claimed in claim 1 wherein at least some of said building units are residential apartments.

12. A building system as claimed in claim 1 wherein at least some of said building units are office suites.

* * * * *